United States Patent [19]

Andreasson

[11] Patent Number: 4,944,897

[45] Date of Patent: Jul. 31, 1990

[54] ARRANGEMENT IN A FUEL SYSTEM

[75] Inventor: Bo C. Andreasson, Kungälv, Sweden

[73] Assignee: Aktiebolaget Electrolux, Stockholm, Sweden

[21] Appl. No.: 306,806

[22] Filed: Feb. 3, 1989

[30] Foreign Application Priority Data

Feb. 5, 1988 [SE] Sweden ..... 8800371

[51] Int. Cl.[5] ..... F02M 15/06

[52] U.S. Cl. ..... 261/35; 261/DIG. 68; 261/DIG. 81

[58] Field of Search ..... 261/DIG. 81, 35, DIG. 68

[56] References Cited

U.S. PATENT DOCUMENTS

| | | | |
|---|---|---|---|
| 4,098,236 | 7/1978 | Okawa | 261/DIG. 81 |
| 4,218,406 | 8/1980 | Detweiler | 261/39.3 |
| 4,563,311 | 1/1986 | Agnew | 261/DIG. 81 |
| 4,716,878 | 1/1988 | Shimada et al. | 261/DIG. 81 |
| 4,770,822 | 9/1988 | Sejimo | 261/DIG. 81 |

FOREIGN PATENT DOCUMENTS

| | | | |
|---|---|---|---|
| 53-117124 | 10/1978 | Japan | 261/DIG. 81 |
| 55-43202 | 3/1980 | Japan | 261/DIG. 81 |

*Primary Examiner*—Tim Miles

*Attorney, Agent, or Firm*—Pearne, Gordon, McCoy & Granger

[57] ABSTRACT

An arrangement for limiting the temperature in a carburetor etc. of an engine prevents evaporation of fuel at a temporary stop in the operation of the engine. A receptacle (30) integrated with the carburetor contains a material (31), e.g. paraffin, with a melting point over the normal operating temperature. At a temperature above this melting point the material absorbs melting heat from the environment causing a limitation of the temperature. In this limited temperature the fuel evaporates much slower and a direct start with the remaining fuel after the operating stop is quite possible.

5 Claims, 1 Drawing Sheet

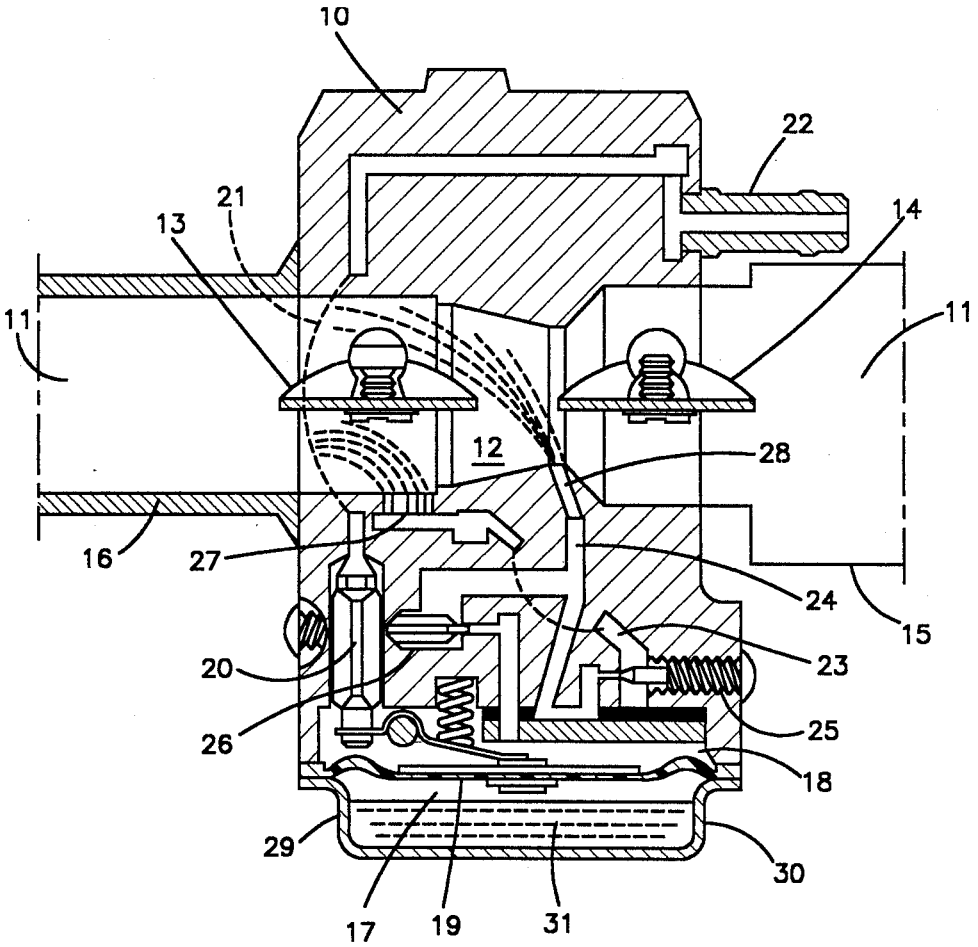
10
22
21
13
14
11
11
12
28
16
27
24
15
20
23
26
25
18
29
30
17
19
31

ARRANGEMENT IN A FUEL SYSTEM

BACKGROUND OF THE INVENTION

The present invention relates to a means in a fuel system used to limit the temperature of the carburetor, conduits and other parts of an engine during after-heating which occurs when the engine has stopped.

The carburetor in eg. chain saws is of the membrane carburetor type which in contrast to a float carburetor, allows positioning of the chain saw in various positions while the saw is is operating. The membrane carburetor has, however, the disadvantage of making it more difficult to restart the engine after a short stop. This is due to the fact that the fuel chamber in the carburetor, from which the fuel is led to the air passage of it, is situated close to the cylinder. This nearness to a heat source causes the fuel in the chamber to become heated. The heated fuel in the chamber then evaporates causing an overpressure which locks the inlet valve to the chamber in a closed position. When the engine is to be started fuel is absent from the chamber and therefore the engine will not start.

SUMMARY OF THE INVENTION

The purpose of the present invention is to eliminate this problem and thus make it possible to start the engine immediately after the engine has stopped. The means for achieving this feature is constituted by a receptacle containing a material with a high specific melting hear and a melting point slightly above the normal work temperature of the carburetor. The receptacle is integrated with the carburetor or screwed in connection to the carburetor. At a carburetor temperature above the melting point of the material the increase in the carburetor temperature is limited because the melting heat of the material is about 10 times higher than the heat capacity of the material constituting the carburetor housing which generally is aluminum. Thus, the material absorbs the major part of the heat emitted by the cylinder. By limiting the heating of the carburetor the fuel evaporates much slower and a direct start of the engine after it has stopped is quite possible. The means is defined in the following claims.

BRIEF DESCRIPTION OF THE DRAWING

An embodiment of a mechanism, in accordance with the invention, is described in the following with reference to the attached drawing shown in cross section the membrane carburetor with the mechanism.

DESCRIPTION OF THE PREFERRED EMBODIMENT

The general construction of a membrane carburetor is thus shown in cross section. A carburetor body 10 has a flow channel 11 with venturi 12, a throttle 13 and a choke 14. The inlet end of the channel is connected to an air filter 15 and the outlet end to the manifold of an engine. The lower part of the body 10 includes an air chamber 17 and a fuel chamber 18 which are separated by a membrane 19. The pressure in air chamber 17 is at or near atmospheric. The membrane 19 controls in the usual way an inlet valve 20 for the fuel entering via connecting channels 21 and tubes 22 which are supplied by a pump. From the fuel chamber the fuel is led via channels 23 and 24 and needle screws 25 and 26 of two nozzles 27 and 28 in the side wall of the channel 11. This is a normal embodiment of a membrane carburetor and therefore no further explanation is necessary.

In the following the preferred embodiment of the mechanism is described. In a lid 29 covering the air chamber 17 a closed volume 30 is created and filled with meltable material 31, e.g. paraffin. This material has a high specific melting heat (175 kJ/kg) and a melting point around 45° C. The body 10 is made of metal having a good thermal conductivity and therefore an equal temperature in the whole body. When the engine is operating the body is heated by the thermal conduction and by heat radiating throughout the body, however the paraffin remains in solid state. A heated engine which stops continues heating the environment, including the carburetor, because the cooling has ceased. In e.g., a chain saw the carburetor temperature raises about 22° C. a moment after the engine is stopped. If such a high temperature increase is allowed, the problem mentioned above arises when restarting the engine.

In the present mechanism the temperature increase is limited to approximately 11° C. When the carburetor temperature is above the melting point of paraffin heat is consumed by the paraffin which keeps the temperature of the carburetor from increasing further. In membrane carburetors such as those used in chain saws this temperature limitation is sufficient to prevent evaporation of the fuel in the carburetor, and restarting of the engine is made possible. After starting the engine the carburetor is recooled to a temperature below the melting point of paraffin and the paraffin returns to solid state.

The following arithmetical example shows that the arrangement is a relatively simple and inexpensive supplement to a membrane carburetor.

The carburetor is made of aluminum with a specific heat=0.9 kJ/kg and weighs 0.11 kg when used in a medium-sized chain saw. At a temperature increase of 22° C. the heat quantity received will be $$22 \times 0.11 \times 0.9 = 2.2 \text{ kJ}$$

If the increase shall stop at 11° C. the paraffin body must absorbe half of this heat quantity i.e. 1.1 kJ. The specific melting heat for paraffin is assumed to be 175 kJ/kg. If the weight of the quantity required is estimated to be $\times$kg then:

$$175 \times = 1.1 \text{ of which}$$

$$\times = 0.0063 \text{ kg} = 6.3 \text{ g paraffin.}$$

After restarting the engine the paraffin adopts solid state in the course of a few seconds as the evaporation heat for the fuel dissipates from the carburetor body and the melted paraffin is cooled. The specific evaporation heat of the fuel is as high as the specific melting heat of the paraffin.

In chain saws after heating from a stopped engine also takes place in the fuel conduit and in the tank. Such a heating with subsequent vaporization of the fuel causes operating disturbances of the engine. The mechanism described can be applied at many places in the fuel system where such problems arise. The principle of arranging enclosed quantities of paraffin or other meltable material is suitable when the after heating is temporary and the engine adopts a normal temperature after a period of cooling. The location and design of the volume 30, shown here, is only one possibility among several ones to realize the invention. It is considered self-evident that each adoption of the principle requires its special choice of material and embodiment.

I claim:

1. In a fuel system of an engine having a membrane-type carburetor including a carburetor body, a flow channel with a venturi, the inlet end of the flow channel connected to an air filter and the outlet end of the flow channel connected to a manifold of the engine; a throttle, and a choke; the lower portion of the carburetor body including an air chamber and a fuel chamber separated by a membrane that controls an inlet valve for fuel entering the fuel chamber, wherein an operating temperature is created in the fuel system when the engine is running, and an after-temperature is created in the fuel system immediately after the engine is stopped, the improvement, comprising:

a body of meltable material (31) in a closed volume (30), said closed volume (30) being formed in the lower portion of the carburetor body on the air chamber side of the membrane, said body of meltable material (31) remaining in a solid state when said operating temperature is present in said fuel system and having a melting point lower than the after-temperature present in the fuel system immediately after the engine is stopped whereby said meltable material (31) absorbs heat in said fuel system created by said after-temperature.

2. In a fuel system as recited in claim 1, the improvement wherein the meltable material (31) has a specific melting heat at least 10 times higher than a specific heat of the carburetor body.

3. In a fuel system as recited in claim 2, the improvement wherein the carburetor body is aluminum and the meltable material is paraffin.

4. In a fuel system as recited in claim 1, the improvement wherein said closed volume (30) is formed by a cavity in the lower portion of the carburetor body.

5. In a fuel system as recited in claim 1, the improvement wherein said closed volume (30) constitutes a receptacle fixed to the lower portion of the carburetor body.

* * * * *